US010012059B2

(12) United States Patent
Romer et al.

(10) Patent No.: US 10,012,059 B2
(45) Date of Patent: Jul. 3, 2018

(54) GAS LIFT OPTIMIZATION EMPLOYING DATA OBTAINED FROM SURFACE MOUNTED SENSORS

(71) Applicants: Michael C. Romer, The Woodlands, TX (US); Ted A. Long, Spring, TX (US); Tony W. Hord, Spring, TX (US); Michael K. Johnson, Spring, TX (US)

(72) Inventors: Michael C. Romer, The Woodlands, TX (US); Ted A. Long, Spring, TX (US); Tony W. Hord, Spring, TX (US); Michael K. Johnson, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 403 days.

(21) Appl. No.: 14/796,862

(22) Filed: Jul. 10, 2015

(65) Prior Publication Data

US 2016/0053593 A1 Feb. 25, 2016

Related U.S. Application Data

(60) Provisional application No. 62/040,273, filed on Aug. 21, 2014.

(51) Int. Cl.

| | |
|---|---|
| ***G05D 7/00*** | (2006.01) |
| ***G05D 11/00*** | (2006.01) |
| ***E21B 43/12*** | (2006.01) |
| ***E21B 41/00*** | (2006.01) |
| ***E21B 47/06*** | (2012.01) |
| ***F04F 1/08*** | (2006.01) |

(52) U.S. Cl.
CPC ..... *E21B 43/122* (2013.01); *E21B 41/0092* (2013.01); *E21B 47/06* (2013.01); *F04F 1/08* (2013.01)

(58) Field of Classification Search
CPC .... E21B 43/122; E21B 41/0092; E21B 47/06; F04F 1/08
USPC ..... 700/282
See application file for complete search history.

(56) References Cited

U.S. PATENT DOCUMENTS

| | | | |
|---|---|---|---|
| 4,480,960 | A | 11/1984 | Streib |
| 5,031,697 | A | 7/1991 | Wellington et al. |
| 6,595,294 | B1 | 7/2003 | Dalsmo et al. |
| 7,474,969 | B2 | 1/2009 | Poulisse |
| 8,214,186 | B2 | 7/2012 | Cuevas et al. |

(Continued)

FOREIGN PATENT DOCUMENTS

| | | |
|---|---|---|
| WO | WO 2007/116008 | 10/2007 |
| WO | WO 2009/017900 | 2/2009 |
| WO | WO 2011/161513 | 12/2011 |

*Primary Examiner* — Mohammad Ali
*Assistant Examiner* — Md Azad
(74) *Attorney, Agent, or Firm* — ExxonMobil Upstream Research Company Law Department

(57) ABSTRACT

A method of optimizing the operation of a gas lift well including the steps of: collecting data from at least one surface mounted sensor, the at least one surface mounted sensor including a skin-mounted temperature sensor, the at least one surface mounted sensor mounted to the gas lift well's surface equipment; collecting ambient temperature data; and determining gas lift performance from data so obtained. A system and field test kits for optimizing the operation of a gas lift well.

23 Claims, 4 Drawing Sheets

(56) References Cited

U.S. PATENT DOCUMENTS

| | | | | |
|---|---|---|---|---|
| 2003/0047308 | A1* | 3/2003 | Hirsch | E21B 17/003 166/250.15 |
| 2005/0199391 | A1 | 9/2005 | Cudmore et al. | |
| 2006/0090892 | A1* | 5/2006 | Wetzel | E21B 47/01 166/250.01 |
| 2009/0034368 | A1* | 2/2009 | Johnson | E21B 47/14 367/83 |
| 2010/0198533 | A1 | 8/2010 | Peacock et al. | |
| 2011/0040501 | A1 | 2/2011 | Martin et al. | |
| 2011/0060472 | A1* | 3/2011 | Ocondi | E21B 43/12 700/282 |
| 2012/0095603 | A1* | 4/2012 | Rashid | E21B 43/00 700/282 |
| 2012/0215364 | A1 | 8/2012 | Rossi | |
| 2013/0041588 | A1 | 2/2013 | Johnson et al. | |
| 2013/0116998 | A1 | 5/2013 | Shirzadi et al. | |
| 2014/0094974 | A1* | 4/2014 | Rashid | G05D 7/0682 700/282 |

* cited by examiner

GAS LIFT OPTIMIZATION EMPLOYING DATA OBTAINED FROM SURFACE MOUNTED SENSORS

CROSS-REFERENCE TO RELATED APPLICATION

This application claims the benefit of U.S. Provisional Patent Application 62/040,273, filed Aug. 21, 2014, entitled "Gas Lift Optimization Employing Data Obtained from Surface Mounted Sensors," the entirety of which is incorporated by reference herein.

FIELD

The present disclosure relates to an apparatus, method and field test kit for optimizing the operation of a gas lift well.

BACKGROUND

Artificial lift is comprised of methods used to transport produced fluids to the surface when reservoir pressure alone is insufficient. Gas lift is a common method that is particularly suited to high-volume offshore wells. A high pressure (up to several thousand psi) gas is injected into the tubing by a casing annulus and travels to a gas lift valve. The operating valve provides a pathway for a designed volume of gas to enter the production tubing. The gas reduces the density of the fluid column, decreasing backpressure on the producing formation. The available reservoir pressure can then force more fluid to the surface. Gas lift valves are effectively pressure regulators and are typically installed during well completion. Multiple gas lift valves may be required to unload completion fluid from the annulus so injected gas can reach the operating valve.

Gas lift is known to be effective and gas lift wells have generally been proven to be low maintenance. One issue, however, is that gas lift wells remain operational even when they are not optimized. That is to say that a non-optimized gas lift well will typically still flow production fluids, albeit at a reduced production rate, even if it is receiving too much, or too little, gas lift gas and/or is lifting from multiple valves or a valve above the operating point. Field diagnostics and modeling have estimated that less than 25% of gas lift wells are optimized, resulting in lost production and inefficient allocation of lift gas.

Gas lift performance is typically gauged through periodic well testing. A test separator is commonly used to measure the volume of liquid and gas produced by a well. A typical well test can take four to twelve or more hours. If a change is made to a well, that is the gas lift rate is increased or decreased, a production choke is adjusted, etc., the well may need several hours to stabilize at a new operating condition before it can be re-tested. A typical method of optimizing a gas lift well is to select a gas lift rate and test the well, and then repeat the process with additional gas lift rates until a gas lift performance relationship is obtained. The most effective/economic gas lift rate can then be selected. Unfortunately, offshore facilities have a limited amount of space for equipment, so a given production platform or vessel may only have one to two test separators for deployment. If each well must be tested at least monthly for regulatory purposes, the test separator may not be available for gas lift optimization.

Other, more technical options for gas lift optimization are not always feasible. For instance, gas lift wells can be modeled with inflow and outflow software and producing pressures and temperatures can be compared to the models. However, this strategy requires accurate models and pressure and temperature transducers located in the flow path. Additionally, the software and sensors must be maintained and periodically recalibrated to ensure accuracy, as well performance changes over time. Individual well, multiphase flow meters could be installed, but these tools are relatively expensive and new to the industry.

As such, there exists a need to address the aforementioned problems and issues. Therefore, what is needed are simpler solutions for gas lift optimization and systems for their implementation.

SUMMARY

In one aspect, disclosed herein is a method of optimizing the operation of a first gas lift well. The method includes the steps of: (a) collecting data from at least one surface mounted sensor, the at least one surface mounted sensor including a skin-mounted temperature sensor, the at least one surface mounted sensor mounted to the gas lift well's surface equipment; (b) collecting ambient temperature data; and (c) determining gas lift performance from data obtained in steps (a)-(b).

In some embodiments, the at least one surface mounted sensor includes at least one additional sensor selected from a skin-mounted acoustic sensor and a skin-mounted vibration sensor.

In some embodiments, the method includes the step of compensating data obtained from the skin-mounted temperature sensor for ambient temperature.

In some embodiments, the method includes the step of (d) varying the gas lift rate of the first gas lift well and repeating steps (a)-(c).

In some embodiments, the step of determining gas lift performance includes qualitatively determining the rate of gas lift well liquids produced.

In some embodiments, the method includes the step of (e) adjusting gas lift parameters to maximize the rate of gas lift well liquids produced from the first gas lift well.

In some embodiments, the method includes the step of combining the information collected in steps (a)-(e) with well test information to create a database of measurements versus expected flow rates.

In some embodiments, the method includes the step of repeating steps (a)-(e) at a second gas lift well, the second gas lift well sharing a reservoir with the first gas lift well and comparing the production of the second gas lift well to the production of the first gas lift well.

In some embodiments, the at least one surface mounted sensor includes a plurality of surface mounted sensors including a skin-mounted temperature sensor, a skin-mounted acoustic sensor and a skin-mounted vibration sensor.

In some embodiments, the skin-mounted acoustic sensor comprises a piezoelectric acoustic emission sensor.

In some embodiments, the gas lift well liquids comprise a mixture of hydrocarbons and water.

In another aspect, disclosed herein is a system for optimizing the operation of a gas lift well. The system includes: (a) at least one surface mounted sensor, the at least one surface mounted sensor including a skin-mounted temperature sensor; (b) an ambient temperature sensor positioned so as to monitor ambient temperature conditions at or near the well; and (c) a computer comprising storage means and a processor for processing data obtained from the plurality of surface mounted sensor and the ambient temperature sensor, the computer programmed to determine gas lift performance from the data obtained.

In some embodiments, the at least one surface mounted sensor includes at least one additional sensor selected from a skin-mounted acoustic sensor and a skin-mounted vibration sensor.

In some embodiments, the computer is programmed to adjust the data obtained from the skin-mounted temperature sensor for ambient temperature.

In some embodiments, the computer is programmed to process data obtained over a plurality of gas lift rates.

In some embodiments, the computer is programmed to qualitatively determine the rate of gas lift well liquids produced.

In some embodiments, the data obtained by the plurality of surface mounted sensors and the ambient temperature sensor is combined with information obtained during well testing to create a database of measurements as a function of expected flow rates, the data stored in the storage means of the computer.

In some embodiments, the at least one surface mounted sensor includes a plurality of surface mounted sensors including a skin-mounted temperature sensor, a skin-mounted acoustic sensor and a skin-mounted vibration sensor.

In some embodiments, the skin-mounted acoustic sensor comprises a piezoelectric acoustic emission sensor.

In some embodiments, the gas lift well liquids comprise a mixture of hydrocarbons and water.

In yet another aspect, disclosed herein is a field test kit for optimizing the operation of a gas lift well. The field test kit includes: (a) a plurality of surface mounted sensors, the surface mounted sensors including a skin-mounted temperature sensor and at least one additional sensor selected from a skin-mounted acoustic sensor and a skin-mounted vibration sensor, the plurality of surface mounted sensors for mounting to the gas lift well's surface equipment; (b) an ambient temperature sensor for positioning so as to monitor ambient temperature conditions at or near the well; and (c) a computer comprising storage means and a processor for processing data obtained during testing from the plurality of surface mounted sensors and the ambient temperature sensor, the computer programmed to determine gas lift performance from the data obtained.

In some embodiments, the skin-mounted acoustic sensor comprises a piezoelectric acoustic emission sensor.

DETAILED DESCRIPTION

FIGS. 1-4 provide illustrative, non-exclusive examples of a method, system and field test kit for optimizing the operation of a gas lift well, according to the present disclosure, together with elements that may include, be associated with, be operatively attached to, and/or utilize such a method, system or field test kit for optimizing the operation of a gas lift well.

In FIGS. 1-4, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Although the approach disclosed herein can be applied to a variety of artificially lifted well designs, the present description will primarily be related to the optimization of a well in which a gas lift system is used to artificially lift the well fluid.

By "surface mounted sensor" is meant a sensor capable of being mounted to a gas lift well's surface equipment, such as the skin surface of a pipe, tubular or other well component, the sensor capable of conveying information concerning conditions relatable to an aspect of fluid flow, including temperature, pressure, fluid flow rate, vibration, acoustics or the like.

Figure 1:
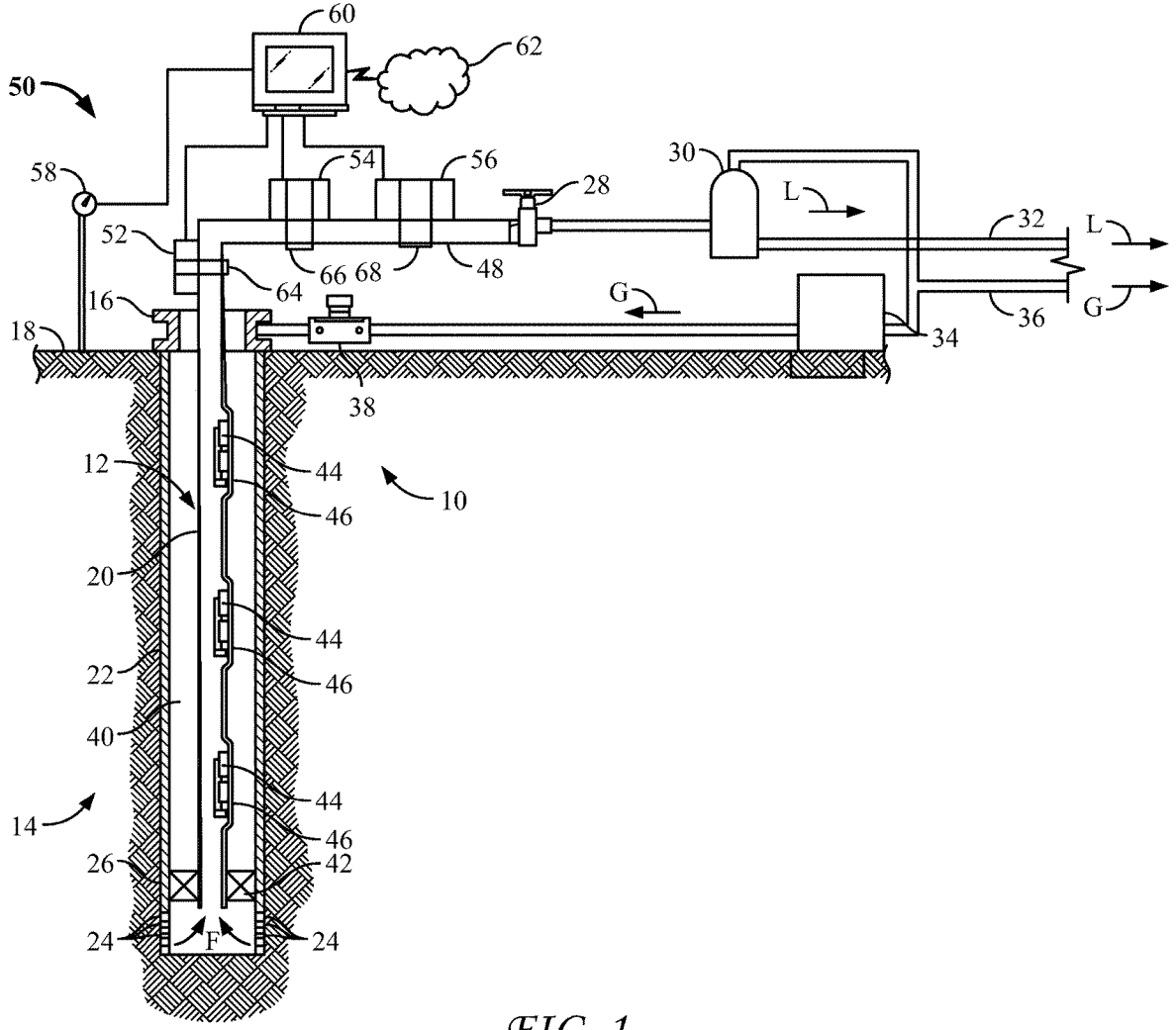
FIG. 1 presents a schematic view of an illustrative, nonexclusive example of a system for optimizing the operation of a gas lift well producing a multi-phase fluid, according to the present disclosure.

Referring now to FIG. 1, one embodiment of a gas lift well 10 is illustrated. In this embodiment, gas lift well 10 is used to produce fluid from a wellbore 12 drilled or otherwise formed in a geological formation 14. A wellbore section of the gas lift system 10 is suspended below a wellhead 16 disposed, for example, at a surface 18 of the earth. A tubing 20 provides a flow path within wellbore 12 through which well fluid F is produced to wellhead 16.

As shown, wellbore 12 is lined with a wellbore casing 22 having perforations 24 through which fluid F flows from formation 14 into wellbore 12. For example, a hydrocarbon-based fluid F may flow from formation 14 through perforations 24 and into wellbore 12 adjacent an intake 26 of tubing 20. Upon entering wellbore 12, the well fluid F is produced upwardly by gas lift system 10 through tubing 20 to wellhead 16. From wellhead 16, the produced well fluid F is directed through control valve 28 to a separator 30 where gas G and liquid L are separated. The substantially liquid portion L of well fluid F may be directed to another location (not shown), such as, by way of example, through conduit 32.

Although gas lift system 10 may comprise a wide variety of components, the example in FIG. 1 is illustrated as having a gas compressor 34 that receives an injection gas from separator 30, and, optionally, from a gas source (not shown) fed by conduit 36. Gas compressor 34 forces the gas through a flow control valve 38, through wellhead 16 and into the annulus 40 between tubing 20 and casing 22. A packer 42 is designed to seal annulus 40 around tubing 20. In some embodiments, packer 42 is disposed proximate intake 26, as shown.

The pressurized gas G flows through the annulus 40 and is forced into the interior of tubing 20 through one or more gas lift valves 44, which may be disposed, in some embodiments, in corresponding side pocket mandrels 46. The gas flowing through gas lift valves 44 draws well fluid into intake 26 and upwardly through the interior of tubing 20. The mixture of injected gas G and well fluid F move upwardly through control valve 28 and are separated at separator 30 which directs liquid L through conduit 32 and the injection gas G back to gas compressor 34, wherein the gas lift well liquids comprise a mixture of hydrocarbons and water.

As may be appreciated, well fluid F combined with injected gas lift gas G comprises a multiphase fluid, resulting in a major portion of gas and a minor portion of liquids at surface flowline conditions. In some embodiments, well fluid F may comprise greater than about 50% gas and less than about 50% liquids, or about 60% gas and about 40% liquids, or about 70% gas and about 30% liquids, or about 80% gas and about 20% liquids, or about 90% gas and about 10% liquids, or about 95% gas and about 5% liquids or greater than about 95% gas and less than about 5% liquids. There may be production periods where well fluid F may comprise substantially all gas, with intermittent or varying liquid production periods. The term multiphase fluid merely refers to a fluid that in some embodiments or occasions may have multiple phases present, while during other embodiments or occasions may comprise substantially 100% gas. The phase category of gas or liquid is determined at or near the well surface or wellhead.

Still referring to FIG. 1, a system 50 for optimizing the operation of a gas lift well 10 is depicted. System 50 includes at least one surface mounted sensors. The at least one surface mounted sensor includes at least one skin-mounted temperature sensor 52, which may be a temperature transducer, thermocouple, thermister, resistance temperature detector (RTD), or the like. In some embodiments, the at least one surface mounted sensor include a plurality of surface mounted sensors, including at least one additional sensor selected from a skin-mounted acoustic sensor 54 and a skin-mounted vibration sensor 56. In some embodiments, the plurality of surface mounted sensors includes a skin-mounted temperature sensor 52, a skin-mounted acoustic sensor 54 and a skin-mounted vibration sensor 56. As shown, the plurality of surface mounted sensors are mounted to the gas lift well's surface equipment, such as, by way of example and not of limitation, a production conduit 48. System 50 may also include an ambient temperature sensor 58 positioned so as to monitor ambient temperature conditions at or near the well 10.

In order to process data obtained from the plurality of surface mounted sensors 52, 54 and/or 56, and the ambient temperature sensor 58, a computer 60 comprising storage means (not shown) and a processor for processing (not shown) may be employed. Computer 60 may be operatively connected to the internet to transmit data for monitoring and/or storage to a remote or cloud server 62. As may be appreciated by those skilled in the art, computer 60 may be present at the well site, as shown, or the data transmitted to a remote location via satellite, wireless, telephonic or other means of transmission. As will be described in more detail below, computer 60 is programmed to determine gas lift performance from the data obtained from the plurality of surface mounted sensors 52, 54 and/or 56, and the ambient temperature sensor 58.

As will be described in more detail below, in some embodiments, computer 60 is programmed to adjust the data obtained from the skin-mounted temperature sensor 52 for ambient temperature measurements obtained from the ambient temperature sensor 58.

As may be appreciated by those skilled in the art, a production well producing from a reservoir has a bottomhole temperature (BHT). Produced fluids carry and lose reservoir heat as they flow to surface. The more quickly fluids flow from the reservoir to the surface, the less heat they can lose, and the higher temperature they should have when produced. Hypothetically, if a well were able to move fluids from the reservoir to the surface instantaneously, the measured liquid temperature at the surface would be identical to the BHT. Likewise, if the same well is not flowing for a given time, the measured surface temperature would approach that of the ambient temperature. Using these boundaries, along with the knowledge that gases tend to match the temperature of the liquids they are produced with, external wellhead/flowline and ambient temperatures can be used to qualitatively determine the liquid flow rate of a gas-lifted well.

When a temperature transducer is placed on the skin of a wellhead or flowline, it indicates the temperature of the produced fluids underneath the skin. However, its readings tend to fluctuate with the daily cycles of ambient air heating and cooling. A high-volume well would be less affected by the ambient temperature cycles than a low-volume well, as the produced fluids would transit the same distance and pipe cross-sectional area in less time, resulting in less heat transfer to/from the external environment. Measurements taken at the highest production rates would show a larger difference in producing vs. ambient temperature than the lower production rate measurements. The temperature differences would be more obvious if the measurements were taken at night, when the effects of varying sun, shade, etc. on the transducers would not be in play. Thus, if the differences between the wellhead/flowline and ambient temperatures were recorded at various gas lift injection rates, with a mathematical accounting for ambient temperature fluctuations, a gas lift performance relationship may be determined and the well optimized in accordance therewith.

Figure 2:
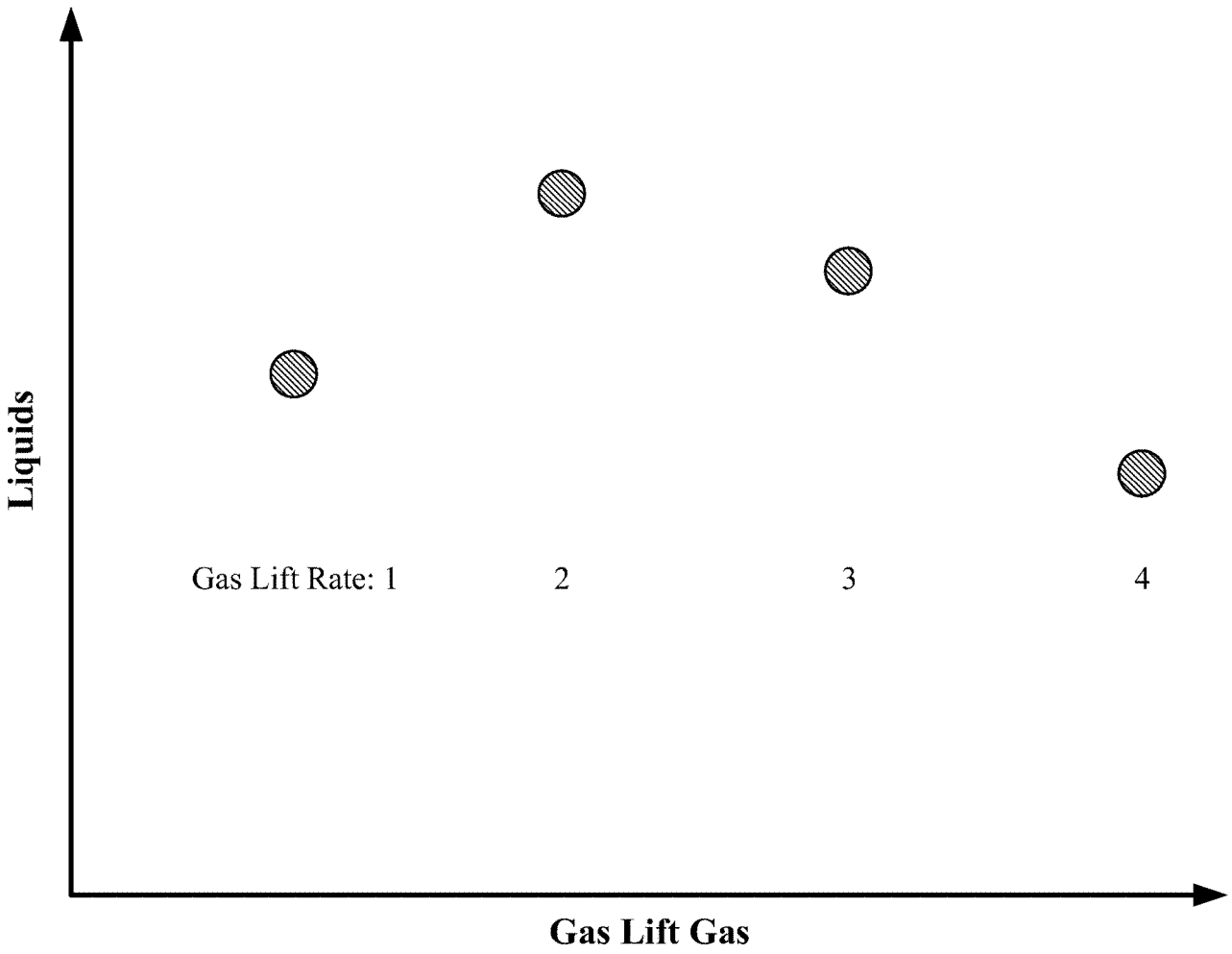
FIG. 2 presents a representative gas lift performance plot, in accordance with the present disclosure.

Referring now to FIG. 2, relative liquid rates vs. gas lift rates are presented for a representative case. As shown, once the gas lift rate increased past rate #2, additional gas reduced production, rather than improved it.

A wide variety of surface mount temperature sensors are commercially available and appropriate for use. Surface mount sensors are used to make non-intrusive surface temperature measurements on pipes or other wellhead components. In some embodiments, as shown in FIG. 1, surface mount temperature sensor 52 is mounted on the production conduit 48, as close to the wellhead 16 as possible. In some embodiments, the surface mount temperature sensor 52 can be secured to the production conduit 48 by using a durable strap 64, such as a heavy duty nylon cable tie or metal hose clamp. A layer of heavy grease may optionally be applied between the production conduit 48 and the temperature sensor 52 to improve heat transfer. The surface mount temperature sensor 52 may optionally be wrapped with a layer of heavy duty pipeline tape (not shown) to waterproof surface mount temperature sensor 52 and prevent the grease, if used, from being washed out. Optionally, a section of waterproof pipe insulation may be installed around surface mount temperature sensor 52 and the production conduit 48. In some embodiments, in order to minimize solar heating, surface mount temperature sensor 52 may be mounted on the underside of the production line 48.

As those skilled in the art appreciate, a flowing well creates some vibration in its production flow line and often generates audible noise. The amount of vibration and noise is dependent on the configuration of the well's surface equipment. The lowermost boundary condition is, of course, the condition when the well is not flowing. Vibration is minimal in this case, with possibly some background noise present due to machinery that may be operating nearby, and no noise emanating from the flow line. As the well's liquid flow rate is increased, the vibration and noise also increases. Acoustic/vibration data is used to determine the relative flowing characteristics of the well. If a well is slugging—encountering rapid pressure fluctuations due to alternating volumes of liquid and gas—it typically produces at a higher average flowing bottomhole pressure and thus a lower production rate than a smoothly flowing well. When slugging and other flow regimes that negatively affect production can be identified, they can be avoided, and gas lift production can be maximized.

Figure 3:
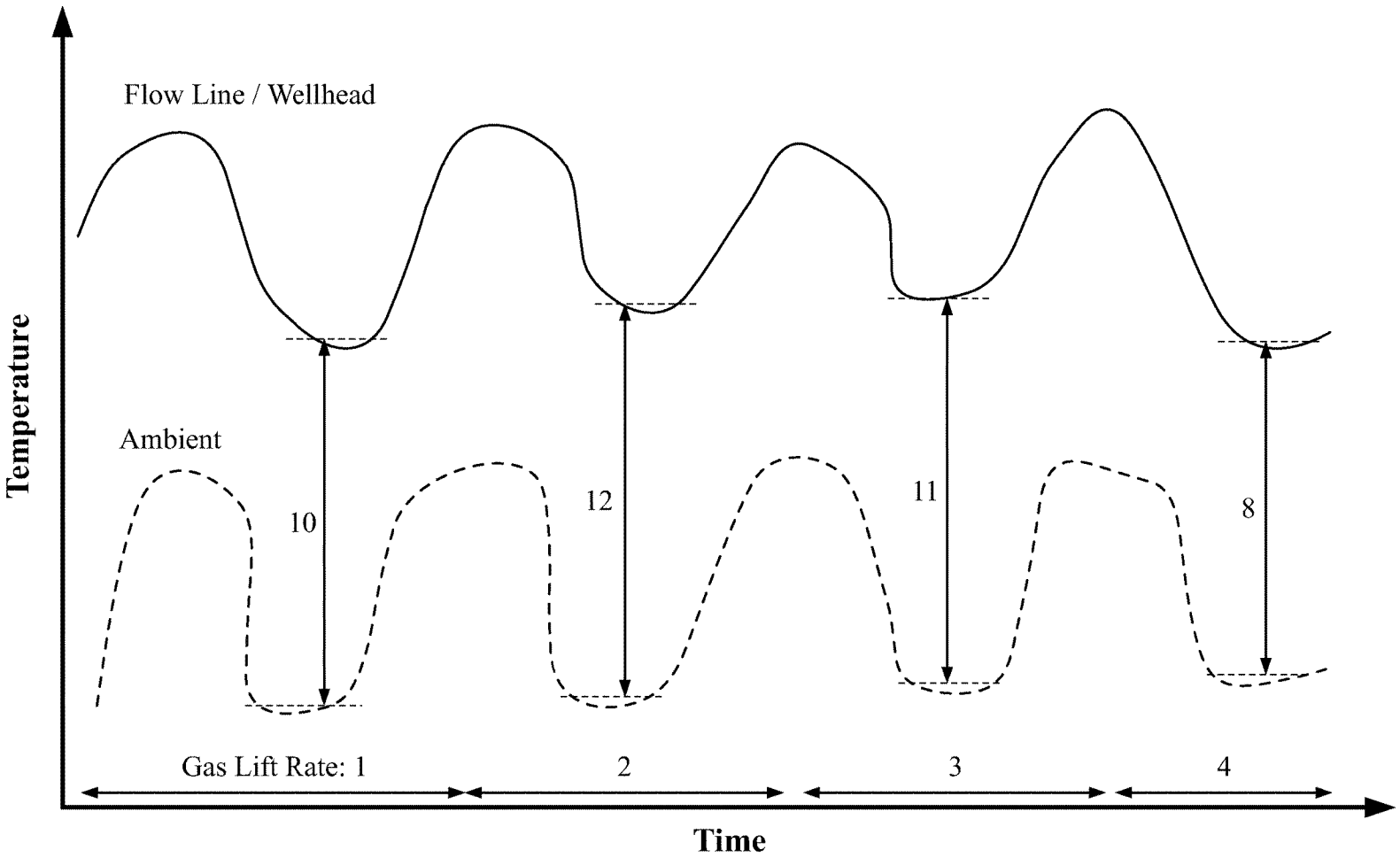
FIG. 3 presents representative flowline and ambient temperature measurements, in accordance with the present disclosure.

Referring to FIG. 3, an example of this gas lift optimization process is shown. In FIG. 3, flowline/wellhead skin temperatures and ambient temperatures are plotted against time. As may be seen, ambient temperature cycling from daily heating and cooling is apparent, with nightly ambient temperatures increasing slightly from day to day. Moreover, the flowline/wellhead temperatures reflect some of the cycling. Additionally, the average flowline/wellhead temperature is higher than the average ambient temperature, since the well's BHT is much higher than that of the ambient air. Note also that a different gas lift rate is applied during each daily temperature period, allowing time for the well to stabilize before the temperature comparisons are made. The vertical arrows represent the difference between the nightly flowline/wellhead and ambient temperatures, while the numbers next to the arrows represent the relative height of the arrows.

As discussed, larger numbers represent higher production flow rates, that is to say that the wellhead/flowline temperature is less affected by ambient temperature fluctuations. Thus, gas lift rate #2 results in the highest production rate of the four gas lift rates shown in the example depicted in FIG. 3. In accordance herewith, the well would be returned to rate #2 to optimize production with the given surface/downhole well configuration.

Figure 4:
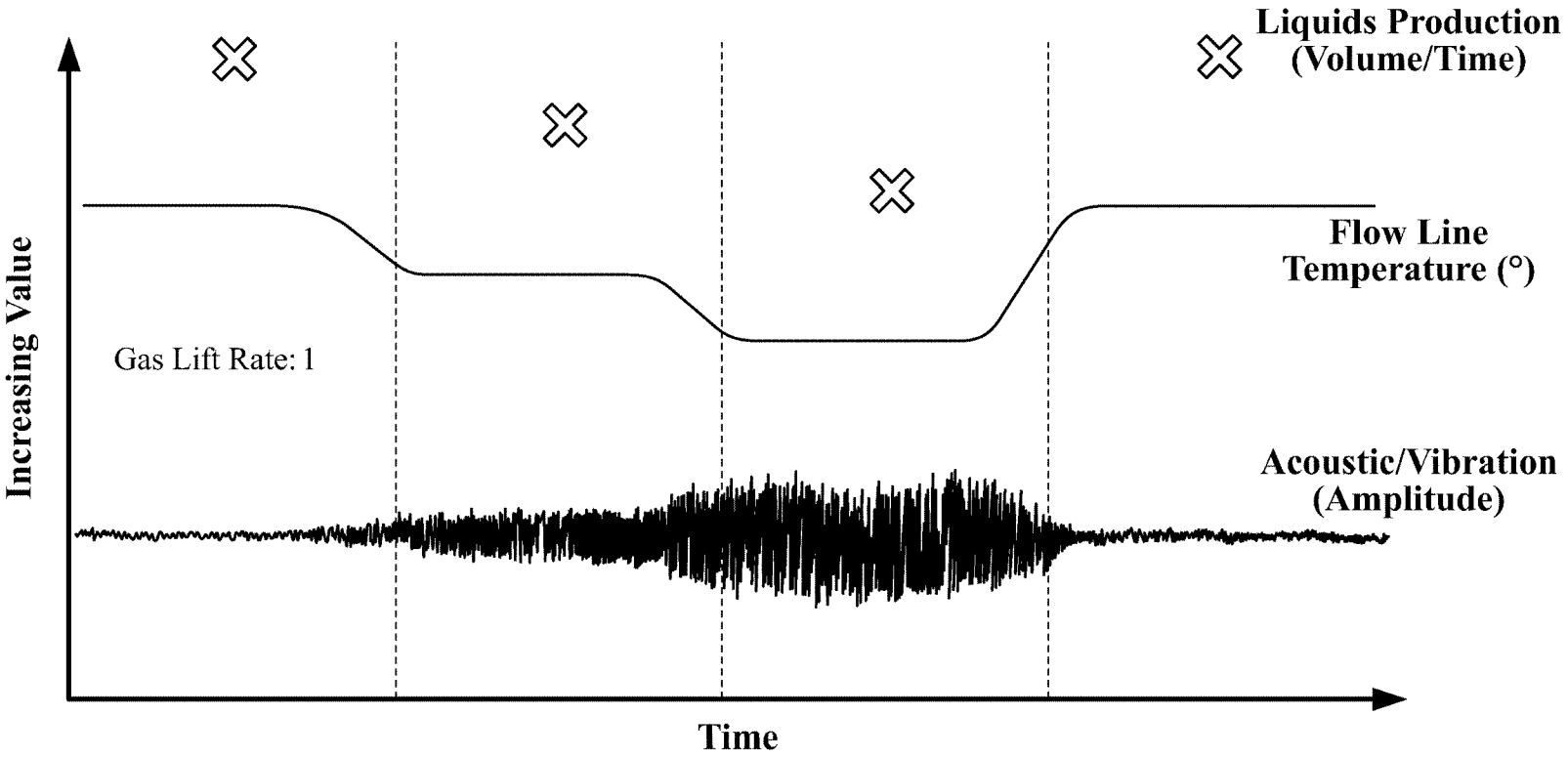
FIG. 4 presents representative acoustic/vibration and flowline temperature data plotted with periodic liquid production rates versus time, with gas lift rate and ambient temperature held constant, in accordance with the present disclosure.

Referring now to FIG. 4, acoustic/vibration and flowline temperature measurement data are plotted along with periodic liquid production rates (well tests) versus time, with gas lift rate and ambient temperature held constant. The ambient temperature is assumed to be constant for illustrative purposes. In this example, it is assumed that the well is most productive when it is the most stable—hence the acoustic/vibration trace is relatively flat and the flowline temperature is at its highest. If the well becomes unstable, whether due to malfunctioning downhole valve(s), a process upset at the surface, etc., the acoustic/vibration trend becomes noisy, reflecting pressure oscillations at the measurement point. The unstable flowing condition increases the average flowing bottomhole pressure, causing liquids production to decrease, and the flowline temperature drops before restabilizing at a new state. Further well instability increases the magnitude of the acoustic/vibration oscillations and the flowline temperature drops even more. When the well regains stability—possibly due to an operations change (more/less gas lift gas, correction of a facilities issue, etc.)—the acoustic/vibration trace flattens, liquids production increases, and the flowline temperature regains its original position. Thus acoustic/vibration data can be used along with temperature data to identify and correct conditions that negatively affect a well's liquid production capabilities.

In some embodiments, the data obtained from the plurality of surface mounted sensors and the ambient temperature sensor may be combined with information obtained during conventional well testing to create a database of measurements as a function of expected flow rates. The database so developed may be, for example, stored in the storage means of the computer 60, or transmitted elsewhere.

Several classes of acoustic sensors possess utility in the practice of the instant invention and are commercially available, ranging from conventional microphones to acoustic emission sensors (AE). Suitable acoustic emission sensors include those available from Vallen Systems GmbH. An AE-sensor converts the surface movement caused by an elastic wave into an electrical signal which can be processed by measurement equipment. The piezoelectric element of an AE-sensor can pick up faint surface movements and converts this movement to an electrical voltage. AE-sensors may be designed to be highly sensitive at a certain frequency or provide a broad frequency response and are available with and without an integral preamplifier. AE-sensors with integral preamplifiers are referred to as active sensors, whereas those without integral preamplifiers are referred to as passive sensors. Generally, AE-sensors with integral preamplifiers are better suited for usage in the field, since setup is faster and the number of connectors is reduced.

When an AE-sensor is employed, it should be mounted firmly to the surface, since it should not move during testing. This also ensures that transmission losses through the interface are minimal. Methods for mounting an AE-sensor can include compression mounting and adhesive mounting. As may be appreciated, a compression mount holds the AE-sensor in contact with the surface through the use of pressure. One compression mounting method employs a magnetic holder and can used when the surface is ferromagnetic. The compressive force may be delivered via springs attached to the magnet. Other compression mounting methods include clamps, adhesive tape or elastic bands.

Another acoustic sensor possessing utility in the practice of the instant invention is the Rosemount 708 Wireless Acoustic Transmitter, available from Rosemount Inc. of Chanhassen, Minn., USA.

Referring again to FIG. 1, in some embodiments a surface mount acoustic sensor 54 is mounted on the production conduit 48, near wellhead 16. In some embodiments, the surface mount acoustic sensor 54 can be secured to the production conduit 48 by using a durable strap 66, such as a heavy duty nylon cable tie or metal hose clamp. The surface mount acoustic sensor 54 may optionally be wrapped with a layer of heavy duty pipeline tape (not shown) to waterproof surface mount acoustic sensor 54.

As is well known in the art, vibration sensors measure a quantity of acceleration and, as such, are a type of accelerometer. Vibration sensors contemplated herein may contain a piezoelectric crystal element bonded to a mass. When the vibration sensor is subjected to an accelerative force, the mass compresses the crystal, causing it to produce an electrical signal that is proportional to the level of force applied. The signal is then amplified and conditioned to create an output signal, which is suitable for use by data acquisition or control systems. Output data from the vibration sensor can either be read periodically using a data collector, downloading to a PC, or routed to a PC or server for continuous monitoring. The vibration sensor should be mounted close to the wellhead on a surface than has been made free from grease and oil. Suitable industrial vibration sensors are available from a variety of sources, including the IMI Sensors Division of PCB Piezoelectronics, located in Depew, N.Y.

Another vibration sensor possessing utility in the practice of the instant invention is the CSI 9420 Wireless Vibration Transmitter, available from Emerson Process Management, Knoxville, Tenn., USA.

Referring again to FIG. 1, in some embodiments a surface mount vibration sensor 56 is mounted on the production conduit 48, near wellhead 16. In some embodiments, the surface mount vibration sensor 56 can be secured to the production conduit 48 by using a durable strap 68, such as a heavy duty nylon cable tie or metal hose clamp. The surface mount vibration sensor 56 may optionally be wrapped with a layer of heavy duty pipeline tape (not shown) to waterproof surface mount vibration sensor 56.

As may be appreciated, the techniques for determining qualitative liquid production changes disclosed herein do not require a test separator. As such, multiple gas lift wells can be optimized over a span of days. In addition, as indicated above, the techniques disclosed herein may be combined with well test information to create a database or map of measurements versus expected flow rates. This information could be used for production surveillance, well performance monitoring, etc. If multiple wells were producing from the same reservoir and had the same surface and downhole configurations, it is possible to compare production among the various wells. Tubing and casing pressures and other external measurements may be added to further refine results, identify process upsets, diagnose operating conditions, etc. Collected data may be communicated to operations/engineering personnel to improve field management processes.

In another aspect of the present disclosure, a method of optimizing the operation of a first gas lift well is provided. The method includes the steps of collecting data from a plurality of surface mounted sensors, the surface mounted sensors including a skin-mounted temperature sensor and at least one additional sensor selected from a skin-mounted acoustic sensor and a skin-mounted vibration sensor, the plurality of surface mounted sensors mounted to the gas lift well's surface equipment; collecting ambient temperature data; and determining gas lift performance from data so obtained.

In some embodiments, the method further includes the step of compensating data obtained from the skin-mounted temperature sensor for ambient temperature. In some embodiments, the method further includes the step of varying the gas lift rate of the first gas lift well and gathering additional data. In some embodiments, the method further includes the step of adjusting gas lift parameters to maximize the rate of gas lift well liquids produced from the first gas lift well. In some embodiments, the method further includes the step of combining the information collected with well test information to create a database of measurements versus expected flow rates. In some embodiments, the method further includes the step of conducting the method disclosed above at a second gas lift well, the second gas lift well sharing a reservoir with the first gas lift well and comparing the production of the second gas lift well to the production of the first gas lift well.

In some embodiments, the plurality of surface mounted sensors includes a skin-mounted temperature sensor, a skin-mounted acoustic sensor and a skin-mounted vibration sensor. In some embodiments, the skin-mounted acoustic sensor comprises a piezoelectric acoustic emission sensor. In some embodiments, the gas lift well liquids comprise a mixture of hydrocarbons and water. In some embodiments, the step of determining gas lift performance includes qualitatively determining the rate of gas lift well liquids produced.

As may be appreciated, the systems disclosed herein may be portable so as to enable the transfer of same from well-to-well, site-to-site. As such, provided is a field test kit for optimizing the operation of a gas lift well. The field test kit includes a plurality of surface mounted sensors, the surface mounted sensors including a skin-mounted temperature sensor and at least one additional sensor selected from a skin-mounted acoustic sensor and a skin-mounted vibration sensor, the plurality of surface mounted sensors for mounting to the gas lift well's surface equipment; an ambient temperature sensor for positioning so as to monitor ambient temperature conditions at or near the well; and a computer comprising storage means and a processor for processing data obtained during testing from the plurality of surface mounted sensors and the ambient temperature sensor, the computer programmed to determine gas lift performance from the data obtained.

All or a portion of the methods, systems and subsystems of the exemplary embodiments can be conveniently implemented using one or more general purpose computer systems, microprocessors, digital signal processors, microcontrollers, and the like, programmed according to the teachings of the exemplary embodiments disclosed herein, as will be appreciated by those skilled in the computer and software arts.

Appropriate software can be readily prepared by programmers of ordinary skill based on the teachings of the exemplary embodiments, as will be appreciated by those skilled in the software art. Further, the devices and subsystems of the exemplary embodiments can be implemented on the World Wide Web. In addition, the devices and subsystems of the exemplary embodiments can be implemented by the preparation of application-specific integrated circuits or by interconnecting an appropriate network of conventional component circuits, as will be appreciated by those skilled in the electrical art(s). Thus, the exemplary embodiments are not limited to any specific combination of hardware circuitry and/or software.

Stored on any one or on a combination of computer readable media, the exemplary embodiments disclosed herein can include software for controlling the devices and subsystems of the exemplary embodiments, for driving the devices and subsystems of the exemplary embodiments, for enabling the devices and subsystems of the exemplary embodiments to interact with a human user, and the like. Such software can include, but is not limited to, device drivers, firmware, operating systems, development tools, applications software, and the like. Such computer readable media further can include the computer program product of a form disclosed herein for performing all or a portion (if processing is distributed) of the processing performed in implementing the methods disclosed herein. Computer code devices of the exemplary embodiments disclosed herein can include any suitable interpretable or executable code mechanism, including but not limited to scripts, interpretable programs, dynamic link libraries (DLLs), Java classes and applets, complete executable programs, Common Object Request Broker Architecture (CORBA) objects, and the like. Moreover, parts of the processing of the exemplary embodiments disclosed herein can be distributed for better performance, reliability, cost, and the like.

As stated above, the methods, systems, and subsystems of the exemplary embodiments can include computer readable medium or memories for holding instructions programmed according to the embodiments disclosed herein and for holding data structures, tables, records, and/or other data described herein. Computer readable medium can include any suitable medium that participates in providing instructions to a processor for execution. Such a medium can take many embodiments, including but not limited to, non-volatile media, volatile media, transmission media, and the like. Non-volatile media can include, for example, optical or magnetic disks, magneto-optical disks, and the like. Volatile media can include dynamic memories, and the like. Transmission media can include coaxial cables, copper wire, fiber optics, and the like. Transmission media also can take the form of acoustic, optical, electromagnetic waves, and the like, such as those generated during radio frequency (RF) communications, infrared (IR) data communications, and the like. Common embodiments of computer-readable media can include, for example, a floppy disk, a flexible disk, hard disk, magnetic tape, any other suitable magnetic medium, a CD-ROM, CDRW, DVD, any other suitable optical medium, punch cards, paper tape, optical mark sheets, any other suitable physical medium with patterns of holes or other optically recognizable indicia, a RAM, a PROM, an EPROM, a FLASH-EPROM, any other suitable memory chip or cartridge, a carrier wave or any other suitable medium from which a computer can read.

The embodiments disclosed herein, as illustratively described and exemplified hereinabove, have several beneficial and advantageous aspects, characteristics, and features. The embodiments disclosed herein successfully address and overcome shortcomings and limitations, and widen the scope, of currently known teachings with respect to removing liquids from gas lift wells.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of optimizing the operation of a gas lift well, comprising the steps of:

providing a wellhead on a gas lift well, the wellhead for receiving a produced fluid stream from the gas lift well;

providing a produced fluid flow conduit for conveying a produced fluid stream away from the wellhead;

providing a gas lift injection conduit for conveying gas lift gas into an annulus of the gas lift well;

providing an adjustable choke on at least one of the produced fluid flow conduit, the gas lift injection conduit, and the wellhead, for controlling at least one of a gas lift gas injection rate and a produced fluid production rate;

providing a skin mounted temperature sensor on an exterior surface of the produced-fluid flow conduit;

providing an ambient temperature sensor to monitor ambient temperature proximate to the skin mounted temperature sensor;

providing apparatus for:

(a) collecting skin temperature data from the skin mounted temperature sensor at a first time period while producing fluids from the gas lift well;

(b) collecting ambient temperature data from the ambient temperature sensor at the first time period;

(c) determining a choke position setting at the first time period;

(d) adjusting the choke position setting to another choke position at another time period and repeating steps (a)-(c);

normalizing the ambient temperature data collected during the first time period with the ambient temperature data collected during the another time period;

comparing the skin temperature data collected at step (a) for the first time period with the skin temperature data collected at step (a) for the another time period, to determine which choke position setting produced the highest normalized skin temperature; and operating the first production well based upon the highest normalized skin temperature, by at least one of;

(i) positioning the choke setting at at least one of the first choke setting, the another choke setting, and yet still another choke setting; and (ii) adjusting a rate of injection of gas lift gas into the gas lift well; and (iii) combinations thereof.

2. The method of claim 1, further comprising a skin mounted acoustic sensor and a skin mounted vibration sensor, on the produced fluid flow conduit.

3. The method of claim 2, further comprising compensating the temperature data collected from the skin mounted temperature sensor for the collected ambient temperature.

4. The method of claim 3, further comprising the step of varying the gas lift rate of the first gas lift well for a determined data gathering period and repeating steps (a)-(c).

5. The method of claim 4, wherein the step of determining gas lift performance includes qualitatively determining the rate of gas lift well liquids produced.

6. The method of claim 5, further comprising the step of (e) adjusting gas lift parameters to maximize the rate of gas lift well liquids produced from the first gas lift well.

7. The method of claim 6, further comprising the step of combining the information collected in steps (a)-(e) with quantitative well test information to create a database of gas lift injection gas rate versus expected produced fluid flow rates.

8. The method of claim 6, further comprising the step of repeating steps (a)-(e) at a second gas lift well, the second gas lift well sharing a reservoir with the first gas lift well and comparing the production of the second gas lift well to the production of the first gas lift well.

9. The method of claim 1, further comprising using on the produced fluid conduit and collecting data from at least one of a skin mounted acoustic sensor and a skin mounted vibration sensor.

10. The method of claim 9, wherein the skin mounted acoustic sensor comprises a piezoelectric acoustic emission sensor.

11. The method of claim 1, wherein the adjustable choke is adjusted automatically, manually, or either selectively automatically and manually.

12. The method of claim 1, wherein the gas lift well produces fluids comprising gas and liquids at flowline conditions within the produced fluid conduit.

13. A system for optimizing the operation of a gas lift well, comprising:

a wellhead on a gas lift well, the wellhead for receiving a produced fluid stream from the gas-lift well;

a produced fluid flow conduit for conveying a produced fluid stream away from the wellhead;

a gas lift injection conduit for conveying gas lift gas into an annulus of the gas lift well;

an adjustable choke on at least one of the produced fluid flow conduit, the gas lift injection conduit, and the wellhead, for controlling at least one of gas lift gas injection rate and produced fluid production rate;

a skin-mounted temperature sensor on an exterior surface of the produced-fluid flow conduit;

an ambient temperature sensor to monitor ambient temperature proximate to the skin-mounted temperature sensor;

apparatus to:

(a) collect skin-temperature data from the skin-mounted temperature sensor at a first time period while producing fluids from the gas lift well;

(b) collect ambient temperature data from the ambient temperature sensor at the first time period; and (c) determine the choke position setting at the first time period;

adjusting the choke position setting to another choke position setting at another time period and repeating steps (a)-(c);

a computer comprising data storage and a processor for;

(i) normalizing the ambient temperature data collected during the first time period with the ambient temperature data collected during the another time period; and (ii) comparing the skin-temperature data collected at step (a) for the first time period with the skin-temperature data collected at step (a) for the another time period, to determine which choke position setting produced the highest normalized skin temperature; and (iii) operating the gas lift well based upon the highest normalized skin temperature of the produced fluid flow conduit, by at least one of;

(A) positioning the choke setting at at least one of the first choke setting, the another choke setting, and yet still another choke setting; and (B) adjusting a rate of injecting the gas lift gas into the gas lift well; and (C) combinations thereof.

14. The system of claim 13, further comprising a skin-mounted acoustic sensor and a skin-mounted vibration sensor, on the produced fluid flow conduit.

15. The system of claim 14, wherein the computer is programmed to adjust the data obtained from the skin-mounted temperature sensor for ambient temperature.

16. The system of claim 15, wherein the computer is programmed to process data obtained over a plurality of gas lift gas injection rates.

17. The system of claim 16, wherein the computer is programmed to qualitatively determine the rate of gas lift well liquids produced with respect to another rate of gas lift well liquids produced.

18. The system of claim 17, wherein the data obtained from the at least one surface mounted sensor and the ambient temperature sensor is combined with information obtained during well testing to create a database of measurements as a function of expected flow rates, the data stored in the storage means of the computer.

19. The system of claim 13, wherein the at least one surface mounted sensor includes a plurality of surface mounted sensors include a skin-mounted temperature sensor, a skin-mounted acoustic sensor and a skin-mounted vibration sensor.

20. The system of claim 19, wherein the skin-mounted acoustic sensor comprises a piezoelectric acoustic emission sensor.

21. The system of claim 13, wherein the gas lift well liquids comprise a mixture of hydrocarbons and water.

22. The system of claim 21, wherein the gas lift well produces fluids comprising gas and liquids at flowline conditions.

23. The system of claim 14, wherein the skin-mounted acoustic sensor comprises a piezoelectric acoustic emission sensor.

* * * * *